United States Patent [19]

Merrill, Jr.

[11] 4,149,845

[45] Apr. 17, 1979

[54] RABBLES AND MATERIAL HANDLING SYSTEMS UTILIZING THE SAME

[75] Inventor: LaVaun S. Merrill, Jr., Englewood, Colo.

[73] Assignee: Marathon Oil Company, Findlay, Ohio

[21] Appl. No.: 755,778

[22] Filed: Dec. 30, 1976

[51] Int. Cl.[2] ..... F27B 9/16

[52] U.S. Cl. ..... 432/138; 202/103; 414/305

[58] Field of Search ..... 214/17 C, 17 CB, 21; 259/82, 88, 108; 202/103, 104, 136, 262; 432/138, 139, 140, 151

[56] References Cited

U.S. PATENT DOCUMENTS

| | | | |
|---|---|---|---|
| 637,864 | 11/1899 | Godfrey et al. | 432/138 |
| 741,300 | 10/1903 | Braniff | 214/17 |
| 822,547 | 6/1906 | Nicolson | 214/17 DB |
| 1,878,581 | 9/1932 | Halden | 202/104 |
| 3,222,141 | 12/1965 | Donaldson | 259/108 X |
| 3,612,497 | 10/1971 | Allred | 202/103 X |
| 3,763,013 | 10/1973 | Allred | 202/103 |

*Primary Examiner*—Albert J. Makay
*Attorney, Agent, or Firm*—Joseph C. Herring; Jack L. Hummel

[57] ABSTRACT

The rabbles of this invention have a concave active face. They are used in a system for processing material including, for example, a substantially circular and horizontal floor, and a rabble system disposed above, but adjacent to, said floor. The rabble system urges material on the floor to desired locations, such as discharge openings, in response to relative motion between the floor and the rabble system. The rabble system includes a plurality of rabbles. Substantially each rabble has a body portion which carries a curved or angled surface. This curved or angled surface defines a concave active face. Each rabble also has a leading edge substantially perpendicular to the floor. The concave active face extends from the leading edge and is both substantially parallel to the leading edge and substantially perpendicular to the floor. Said rabbles are preferably oriented in a system with their body portion adjacent their leading edges at an angle in the range of about 0° to about ±13° to the flow of material and with a portion of their concave active faces oriented to intercept and move material in the desired direction. During relative rotary motion between the floor and the rabbles, this orientation and configuration of the rabbles reduces the build-up and bridging of material in front of and between the leading edges of the rabbles while the concave active faces cause substantial amounts of material to flow across the floor. These rabbles and systems are especially useful in the operation of rotary hearths.

10 Claims, 6 Drawing Figures

RABBLES AND MATERIAL HANDLING SYSTEMS UTILIZING THE SAME

BACKGROUND OF THE INVENTION

1. Field of the Invention

The present invention relates to configuration of a rabble useful for moving material, and to systems and methods utilizing such rabbles for moving material for example, during thermolytic processes in a rotary hearth. More specifically, it relates to methods and apparatus utilizing such rabbles for feeding, conveying and discharging coke during a calcining operation.

2. Prior Art

Oven systems utilizing relative motion between a hearth and rabbles have long been used for heating and calcining material. Such systems normally include, for example, a heating chamber including a roof and cylindrical sidewalls, a circular hearth, a rabble system, a mechanism for imparting relative motion between the rabbles and the hearth, suitable means for the admission of to-be-treated material into the oven, and other means for discharging treated material from the oven. Rabble systems have usually included a plurality of rabbles supported above and extending closely adjacent to the floor of the hearth for engaging and advancing the materials thereon from the area of entry to the point of discharge in response to relative motion between the floor of the hearth and the rabbles. The motion may be provided either by rotating the floor of a hearth while maintaining the rabbles stationary, or revolving the rabbles while maintaining the floor stationary. Such systems may also include ports for the admission of gases, and an exhaust system for combustion by-products and spent gases.

In such prior art rotary hearth systems, the material to be treated has normally been admitted either in the area near the center of the hearth floor and transported by the rabbles to the peripheral edge of the hearth for discharge, or admitted in the area near the peripheral edge of the heath floor and transported by the rabbles to the center of the hearth for discharge. Calcining in rotary furnaces is taught, for example, in U.K. Pat. No. 1,055,857 and U.S. Pat. No. 3,448,012.

In most of such prior art systems, the rabbles have generally been arrayed with an active face oriented to contact and progressively move material on the floor from its point of entry to one or more discharge outlets. The angular orientation and general configuration of prior art rabbles have generally been considered non-critical. The only concern as to the orientation and configuration of the rabbles has been that their active faces contact and move material across the floor in the desired direction during relative motion. The rabbles themselves have generally tended to be plate like and flat in structure. In some instances, linear rabbles have been dished. Generally, their leading edges have been rectilinear, although U.S. Pat. No. 3,475,286 discloses a plow shaped rabble. The angle at which the leading edge of a rabble and the active face of a rabble is oriented with respect to the flow of material on the floor is not known to have previously been considered critical. However, the practice has appeared to favor orientation angles of about 20° to 45° to the flow of material at the leading edge and active face. It is also noted that in the prior art, U.S. Pat. Nos. 319,180; 740,103 and 1,878,581 have disclosed rabble systems in which the angle of the rabbles is variable. However, they disclose no preferred angle, and specifically they disclose no angles in the range of about 0° to about ±13°.

Rotary material handling systems utilizing curved elements have been taught in the prior art. U.S. Pat. No. 319,180 shows a system in which the innermost scraper is curved. However, the active face of this scraper is convex to the direction of material flow. U.S. Pat. Nos. 1,503,234 and 2,973,565 disclose the use of a curved distributing spoke or a scraper, respectively, which traverses the entire radius of the floor to circumferentially distribute or level material on the floor without moving the material in any radial direction. U.S. Pat. No. 3,905,757 uses chains or bars in much the same manner to achieve much the same function.

U.S. Pat. Nos. 3,470,068 and 3,475,286 disclose the use of pairs of staged leading and following rabbles. In these systems, each of the rabbles is at a different height, both rabbles in the pair circumscribe the exact same path on the floor and the rabbles are not in contact with one another to form a convex surface. The leading edges and active faces of the rabbles are not set at low angles in these systems.

Now, in the practice of the prior art, wherein the initial body portions extending from the leading edges of the rabbles are oriented at conventional angles greater than about ±20°, as the rabbles proceed through the material on the floor there is a tendency for the materials to build-up in front of the leading edge of each rabble. This build-up of material causes substantial variations in the height of material on the floor. In a hearth, the variations in height in turn result in uneven movement of the material across the hearth. During calcination of material, such as coke, it is important that the material be heated completely and uniformly. Where the material is distributed unevenly on the hearth, it does not heat uniformly. Furthermore, where the rabbles are closely adjacent to one another, there is a tendency for the built-up material in front of the rabbles to join from rabble to rabble and form a "bridge" of material. Such bridges tend to block the flow of material to the rabbles and thus make the rabbling action inefficient.

Material build-up in front of the leading edges of rabbles is reduced in accordance with the teaching of U.S. Patent Application Ser. No. 756,161, filed simultaneously with the present application. In that application, it is taught that by orienting the trailing edge of a rabble at an angle in the range of about ±2° and about ±13°, build-up of material in front of the leading edge of the rabbles is reduced. Unfortunately, utilizing rabbles with such trailing edge orientation does not always avoid bridging problems between closely adjacent rabbles.

SUMMARY OF THE INVENTION

It is known that the more rabbles which are used in a given system, the more stirring of the material on the floor takes place. However, as the number of rabbles is increased, the rabbles become closer to one another. Where the rabbles are at conventional angles, that is having the initial body portion extending from the leading edge with an orientation of about ±20°, or more, there is a tendency for material to build-up in front of the leading edge of each rabble. Where such rabbles are also closely adjacent to one another, there is a tendency for the built-up material in front of the rabbles to join from rabble-to-rabble and form a bridge of material on the floor in front of the rabbles. These bridges of material tend to block the flow of material to the rabbles and thus make the rabbling action inefficient and the flow of materials on the floor uneven. It has now been discovered that rabbles can be placed more closely adjacent one another with less bridging of material between rabbles if their initial body portion extending from the leading edges are oriented at an angle less than about ±20°, and preferably in the range of about 0° to about ±13°. Unfortunately, where a rabble of a given length is oriented at such low angles, a very limited amount of radial movement of material is realized. This in turn requires that either more or longer rabbles be provided in the system to move the material across the floor. However, where the rabbles are oriented at low angles and also have concave active faces, then bridging of material in front of the rabbles is avoided while substantial movement of material is achieved by the concave rabbles.

With the above in mind, it is the main object of the present invention to provide a rabble configuration useful for moving material, and especially useful in material handling systems, such as rotary hearth systems, whereby the rabbles have a leading edge and a concave active face, the initial body portion extending from the leading edge of the rabble being preferably oriented at a low angle to the flow of material on the floor.

The foregoing objects and other objects defined herein are accomplished, generally, utilizing a rabble having a leading edge, a body portion extending from the leading edge and a body portion carrying a curved or angled surface. This curved or angled surface defines a concave active face which intercepts and moves material in the desired manner. It is utilized, for example, in a material handling system having a circular floor and a rabble system above and adjacent to the floor, wherein the rabble system includes rabbles having a configuration especially when the initial body portion extending from the leading edge of the rabble is at a low angle in the range of about 0° and about ±13° to the flow of material. In a material handling system, including such rabbles, for example, having their leading edges oriented substantially perpendicular to the floor, with the initial body portion extending from the leading edges at an angle in the range of about 0° to about ±13°, during relative rotary motion between the floor and rabbles, material on the floor in contact with the rabbles flows across the floor to desired locations, such as discharge openings, with reduced material build-up and bridging in fron of the rabbles.

These rabbles and this arrangement can be utilized with systems in which the materials are loaded near the center of the floor and moved to the peripheral edge, or loaded near the edge and moved to the center.

The foregoing and other objects, features and advantages of the invention will become apparent from the following more detailed description of preferred embodiments of the invention, as illustrated in the accompanying drawings.

DESCRIPTION OF THE PREFERRED EMBODIMENTS

Angular Orientation Defined

Figure 1:
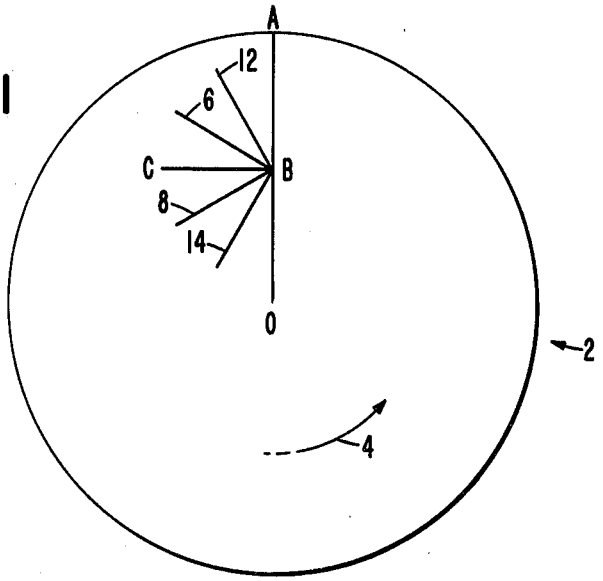
FIG. 1 is a diagramatic explanation of the angular relationships as utilized in this application.

For the purposes of this invention, the following nomenclature will be applied to the angular orientation of elements with regard to a circular floor or hearth. Referring to FIG. 1, a circle 2, which may be considered the geometric equivalent of a circular floor or a rotary hearth, is shown. Circle 2 has a center O and a radius AO. Radius AO may be considered the geometric equivalent of a rabble support. For purposes of discussion, relative rotation exists between circle 2 and radius AO, as shown by arrow 4, in much the same way that relative rotation exists between a hearth and a rabble support. This relative rotation may be due to the rotation of the circle, the rotation of the radius, or the rotation of both. Now, by definition, any line segment BC, perpendicular to any radius AO has an angular orientation of 0°. Furthermore line 6 has an orientation of +30°, element 8 has an orientation of −30°, and elements 12 and 14 are, respectively, oriented at +60° and −60°. All other angular orientations discussed herein are likewise oriented with respect to their intersection with a radius, with a perpendicular to a radius, by definition, being 0°.

The Rabbles

Figure 2:
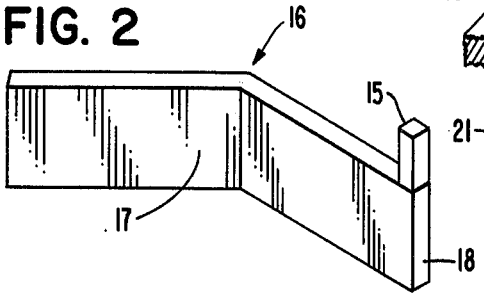
FIG. 2 is an enlarged perspective view of one form of rabble useful in the practice of this invention.
Figure 3:
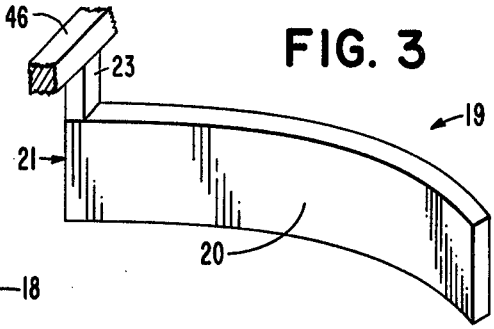
FIG. 3 is an enlarged perspective view of another form of rabble.

In FIG. 2, one form of rabble useful in the practice of the present invention is shown. Rabble 16 is angled and includes active concave face 17 and leading edge 18. Support 15 attached to rabble 16 at its leading edge provides a means by which rabble 16 is attached to and vertically suspended from a rabble support. Another form of rabble is shown in FIG. 3. In this modification, rabble 19 includes curved active concave face 20 and leading edge 21. Support 23 connects rabble 19 to a section of rabble support 46.

The Oven System

Figure 4:
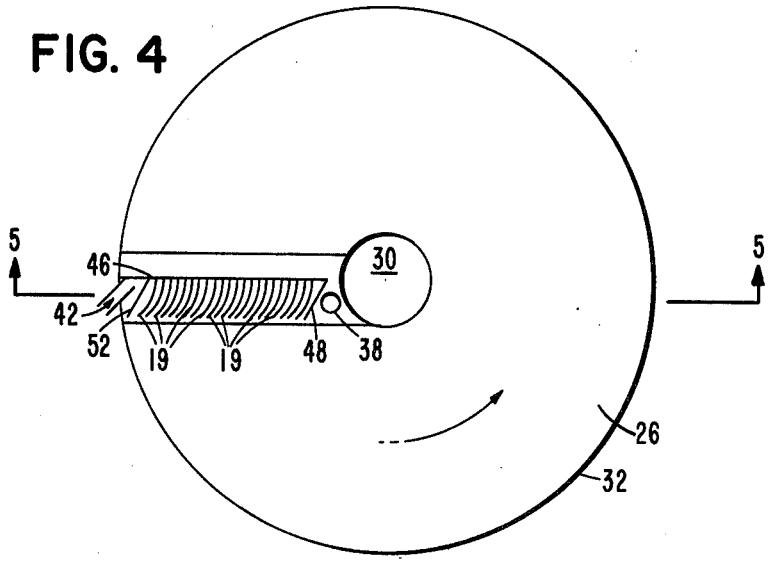
FIG. 4 is a diagramatic top plan view of a rotary hearth according to the present invention.
Figure 5:
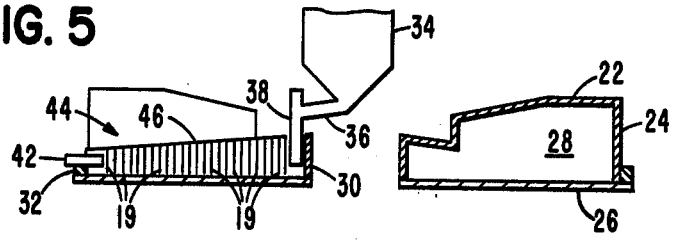
FIG. 5 is an elevation through center section 5—5 of the rotary hearth according to FIG. 4.

Referring to FIGS. 4 and 5, an oven having roof 22, sidewalls 24 and rotary hearth 26, define torroidal heating chamber 28. Hearth 26 is generally round and includes central opening 30 and peripheral edge 32. Feed bin 34 is located outside of the oven and is connected by means of tube 36 to chute 38 located within the oven. The bottom of chute 38 is located above the hearth to deliver material to the hearth for treatment. In this preferred embodiment, chute 38 is located adjacent to central opening 30 of hearth 26. Discharge outlet 42 is provided in the system to allow the removal of treated material from the hearth.

A radially extending depression in roof 22 provides rabble pit 44 in which radial rabble support 46 is located. Inner-most rabble 48, which depends from rabble support 46, serves to urge newly delivered material towards the outboard portions of the hearth, in response to rotation of the hearth in the counter-clockwise direction indicated by the arrow in FIG. 2. Innermost rabble 48 is linear and is oriented with its leading edge at a conventional angle of 30°. Curved rabbles 19 carried by support 46 above hearth 26 are oriented with their leading edges substantially perpendicular to hearth 26 with the initial body portion of the rabble at an angle of about 0° and with their concave active faces 20 also substantially perpendicular to hearth 26 and disposed to move material with which they come in contact during relative rotary motion progressively towards the periphery of the hearth. Outer most rabble 52 is located to plow material off of the hearth and into peripheral discharge outlet 42. Discharge outlet 42 may feed to post treatment facilities, for example, to an art known heat boiler and cooler, not shown. In general, a space of about 0.5 to 4 inches (1.25 to 10 cm.) is maintained between the bottom of rabbles 19 and the bed of hearth 26. However, rabble support 46 is adjustable, thus allowing an adjustment and variation of the vertical penetration of the rabbles into the bed of material under treatment. Additional details of the system and its operation on to-be-treated material are set forth below.

Operation of the System

Referring again to FIGS. 4 and 5, the operation of the oven system in the calcination of coke, for example, is now described in detail. The oven system is pre-heated by art known means, not shown, to a temperature in the range of about 450° C. to about 1800° C., and preferably from about 1000° C. to about 1550° C. Counterclockwise rotation is initiated in hearth 26 by art known means, also not shown. Suitable heating, rotary drive apparatus and other hearth details are disclosed, for example, in U.S. Pat. No. 3,612,497, and are herein incorporated by reference. To-be-treated delayed petroleum coke having an average particle size of about 0.50 inch (1.28 cm.) and a maximum particle size of about 2 inches (5.8 cm.) is fed from bin 34 through tube 36 into feed chute 38. Feed chute 38 is adjusted so that its lower end is about 6 to 8 inches (15.2 to 20.1 cm.) above rotating hearth 26 to provide a circumferential band of coke, not shown, on the hearth around central opening 30. In the structure shown in FIGS. 4 and 5, inner-most rabble 48 is immediately upstream of chute 38. After one nearly complete revolution, the coke deposited from chute 38 contacts and then begins to build-up against the leading or active face of inner-most rabble 48. As coke piles up against the active face of inner-most rabble 48, a portion spills off at the back or trailing edge, thus forming a windrow, not shown. This windrow is in turn carried around by the continued rotation of hearth 26 until it comes into contact with inner-most concave rabble 19, radially outward and next adjacent to rabble 48. This process is repeated progressively until the material reaches rabble 52 near the outer periphery 32 of the hearth. Then additional rotation of the hearth forces the material radially and outward of the last rabble 52 and into discharge opening 42.

During the movement of the coke from chute 38 across the hearth to discharge opening 42, the coke is gradually heated. Heating can be by means of air and combustible gases injected into the furnace by art known inlets, not shown, and ignited, or by the combustion of volatile combustible gases released from the coke as it is heated. In the latter case, it is still required that air or other oxidizing gases be injected into the chamber to support combustion. In the calcining treatment of coke, heat from either form of combustion in chamber 28 is normally caused to exceed 2000° F. (1093° C.). Heat due to combustion in chamber 28 radiates directly onto the material under treatment and is also reflected from roof 22 and sidewalls 24 of the oven thus aiding in the heating of the coke on the hearth.

The hearth rotates at a relatively slow rate, about four minutes for one complete revolution. Therefore, since repeated revolutions of the hearth are required to cause the coke to be shifted radially outward from rabble to rabble, the entire treating process for any given piece of material may require more than one hour.

Coke treated in this system by this process is calcined into a form of volatile free, dense carbon. It is useful, for example, for the production of electrodes used in the electrolytic production of aluminum, and in other electrolytic operations.

Utilizing this system wherein the leading edges of the majority of the rabbles are substantially perpendicular to hearth 26 with the initial body portions of the rabbles oriented at an angle in the range of about 0° and ±13°, and specifically, as in this preferred embodiment, at an angle of about 0° and with their concave active faces 20 also substantitally perpendicular to hearth 26, the material is found to flow more evenly across the floor and with less bridging than in systems in which the orientation of the leading edge and body portion of the rabbles is at an angle significantly greater than about ±13°.

Alternative Embodiments

A variety of modifications, including those obvious to one skilled in the art, are to be included within the scope of the invention as defined in the specification and the claims appended hereto.

Figure 6:
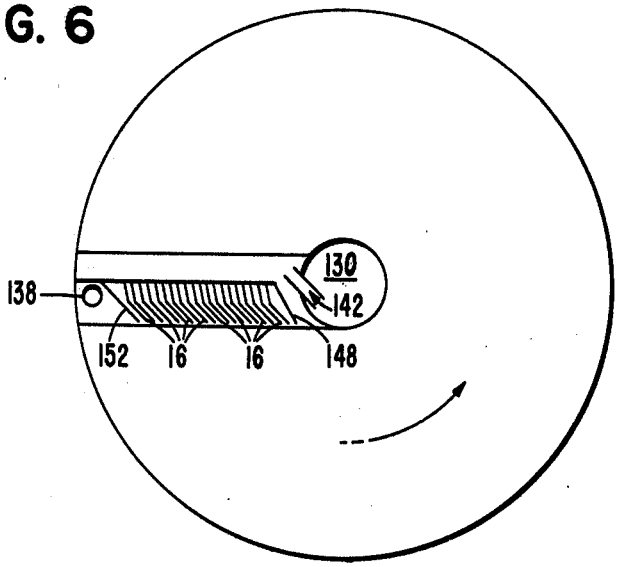
FIG. 6 is a top plan view showing a modified material handling system.

Referring to FIG. 6, one alternative embodiment of the present invention is shown wherein like reference characters in FIGS. 4 and 5 are increased, where possible, by 100 to designate like parts. In this version, feed chute 138 is located to deliver material to the periphery of the hearth. Outermost rabble 152, oriented at an angle of about −45°, moves material deposited on the hearth inwards, toward the center of the hearth. Then, additional rotation of the hearth causes rabbles 16, oriented at their leading edge and body portion at an angle of about −12°, to move material progressively inward until the material reaches innermost rabble 148. With continued rotation, rabble 148 forces the material radially inward and into discharge outlet 142. In this modification, wherein material is fed onto the hearth at the periphery and discharged at the center, the use of a plurality of concave rabbles oriented at an angle of about −12° provided uniform movement of the material across the hearth with little build-up or bridging in front of the leading edge of the rabbles.

Other variations encompassing the present invention will be apparent to one skilled in the art. For example, more than one radial array of rabbles oriented and configured in accordance with teaching of the present invention may be utilized to either increase stirring or maintain control of the material undergoing treatment on the hearth. The rabbles may be arrayed in other than a straight radial line. For example, they may affect a spiral or a random pattern. The only requirement is that some of the rabbles have the necessary concave active face. It is also desirable that the body portion adjacent the leading edge of the rabble be oriented at a low angle as it intersects the radius of the hearth, preferably in the range of about 0° and about ±13°. Due to their configuration, it is very easy for the trailing edge of each rabble to overlap or be sufficiently close to the next rabble to affectively move the material from the area of deposit on the hearth to the discharge outlet. However, in preferred embodiments of this invention, an excess number of rabbles can be used without undesirable bridging between the leading edges of rabbles.

While the spacing between the radially arrayed rabbles may, if desired, be equal, these spacings may also vary to compensate for changes in the concentric areas of the hearth so as to assist in maintaining the substantially constant depth of the bed of material across the hearth. Of course, the more rabbles used, the more stirring of the material on the bed will be achieved. Conversely, where stirring is not an important factor using rabbles with the concave configuration, as taught herein, requires a lesser number of rabbles to traverse the floor with sufficient proximity or overlap from rabble to rabble to move material across the floor. In this latter situation, the orientation of the leading edge of the rabbles becomes less critical.

Nothing in the teaching of this invention will prevent rabbles having different leading edge angles, both within and without the preferred range, in a single system. Of course, the greater the percentage of rabbles which have their leading edges at a preferred angle, the more efficiently the system will operate in terms of providing a smooth and even flow of material across the floor without bridging of material in front of the leading edge.

For purposes of clarity, the rabbles have been shown as being supported at their leading edges by a rabble support which conforms to a radius of the hearth. Clearly, this arrangement is not limiting. The rabble support need not be a radius and rabbles will not normally be supported solely at their leading edge. All that is required for the practice of some preferred embodiments of this invention is that regardless of the location of the rabble support and its connection of the rabbles, the body portion adjacent the leading edge of the rabbles be oriented at a low angle where it intersects a radius. Where the floor is circular, the angles are defined as set forth in FIG. 1.

The rabbles themselves may be constructed of high temperature materials, such as steel or mild steel coated with ceramic. They may be cooled by fluids circulating through the rabbles. One especially useful form of rabble is constructed of open grid metal filled with thermally insulating ceramic material, and includes a provision for circulating cooling fluids, as described in U.S. Pat. No. 3,740,185.

The location of the material inlet chute is not critical. The chute may be located near the center of the hearth, or near the periphery of the hearth, or intermediate both the center and the peripheral edge of the hearth, depending on the direction of material movement desired. It is art known to utilize multiple supply chutes at either the center or periphery of the hearth, in conjunction with multiple rabble systems, to move a plurality of materials across the hearth, without commingling the materials, to preselected outlets, see U.S. Pat. No. 3,859,172.

In the examples shown, the hearth rotates and the rabbles are stationary, and this is indeed the preferred embodiment. However, the present invention contemplates systems in which the hearth is stationary and the rabble system rotates around the center of the hearth.

While substantially horizontal and round floors have been described in the foregoing examples, variations and modifications are encompassed by these terms. For example, any floor having a horizontal component sufficient to retain material deposited thereon in repose, until acted on by the rabble system, is "substantially horizontal", within the meaning of this invention. In a similar manner, while round floors are most conveniently utilized in the practice of this invention, the shape of the floor is not a limiting factor in the operation of the rabbles of the present invention. Since the invention is primarily related to the configuration of the rabbles, and secondarily to the orientation of the body portions adjacent the leading edge of the rabbles in relation to the motion of the material on a floor, floors of almost any shape will function in the operation of this invention. For example, in the most extreme situation, rabbles having the desired configuration, with or without the leading edge orientation can operate, within the teaching of this invention, in relative motion with a linear floor.

While this method and apparatus has been shown to be useful, for example, for calcining coke for use in the production of electrodes, it is also useful for the continuous calcining, coking and/or devolatilizing of any carbonaceous material, such as non-coking coal, anthracite coal, briquettes or pellets containing bituminous coking coal, green petroleum coke, wood products and other similar carbonaceious materials. It can also be used for calcining limestone, dolomite and cement rock, the decomposition of carbonates, chlorides and sulfates, and the activation or reactivation of charcoal.

It is therefore seen that the foregoing sets forth an improved concave rabble, and a material handling system utilizing such a rabble, useful, for example, in a rotary hearth. The system includes a floor and a rabble system disposed above the floor, wherein relative motion may be imparted between the floor and the rabble system. The system is especially unique in providing a plurality of concave rabbles having their body portions adjacent the leading edges oriented at a low angle of about 0° to about ±13° to the floor and their concave active faces substantially perpendicular to the floor. This orientation of the rabbles causes material on the floor to undergo an even flow as it travels across the floor and reduces material build-up and bridging in front of the rabbles. Such a system has been detailed. Modified systems have been shown.

Based on the teaching of the present invention, equivalent rabble configurations may be determined. Additionally, useful low angles may be found for slight variations in the system. For example, variations of material size and/or density and the relative speed between the floor and the rabbles may result in slight variations in the range of the angles or configuration of the rabbles.

While the foregoing preferred embodiments of the invention have been described and shown, it will be understood by those skilled in the art that the foregoing and other alterations and modifications may be made therein without departing from the spirit and scope of the invention as claimed.

What is claimed is:

1. A materials handling system, said system including:

a floor;

means above said floor for delivering material to said floor and material outlet means on said floor, there being a given distance between the floor below said material delivery means and said delivery outlet means;

a rabble means, said rabble means including a solid body portion having a front end and a far end, a leading edge carried at the front end of said solid body portion, said leading edge substantially perpendicular to said floor, said solid body portion including an initial body portion extending from said leading edge of said rabble means said initial body portion oriented at an angle in the range of about 0° and about ±13° to the flow of material on the floor, and a continuous concave active face carried by said body portion, said active face extending from said leading edge and terminating at said far end with a substantial portion of the concavity of said active face parallel to said leading edge and substantially perpendicular to said floor, and wherein there is a given distance across the concavity of the active face from the leading edge to the far end of said active face, the given distance across said active face being less than the given distance between said floor below said material delivery means and said material outlet means of said floor.

2. The material handling system of claim 1 wherein the active face of said rabble is a continuous smooth curve.

3. The materials handling system of claim 1 wherein the concave active face includes at least one plane portion.

4. The materials handling system of claim 1 wherein the concave active face is defined by a plurality of plane surfaces.

5. The materials handling system as in claim 1 wherein said floor is generally circular and the relative motion is rotary.

6. The materials handling system as in claim 5 wherein the generally circular floor rotates and the rabbles are substantially stationary.

7. The materials handling system, as in claim 1, further including:

a heated chamber including a roof and sidewalls;

wherein said floor is a substantially round hearth within said chamber, said hearth having a center and having a peripheral edge, wherein said rabble means includes a plurality of radially spaced rabbles within said chamber, said rabbles disposed above, but adjacent to, said hearth; and means for providing relative rotary motion between said hearth and said rabbles.

8. The material handling system as in claim 7 wherein the hearth rotates and the rabbles are substantially stationary.

9. The materials handling system as in claim 7 wherein said material delivery means are located near the center of said hearth and said material outlet means are located near the peripheral edge of said hearth.

10. The materials handling system as in claim 7 wherein said material delivery means are located near the peripheral edge of said hearth and said material outlet means are located near the center of said hearth.

* * * * *

UNITED STATES PATENT OFFICE
CERTIFICATE OF CORRECTION

Patent No. 4,149,845 Dated April 17, 1979

Inventor(s) LaVaun S. Merrill, Jr.

It is certified that error appears in the above-identified patent and that said Letters Patent are hereby corrected as shown below:

I73] Delete "MARATHON OIL COMPANY, Findlay, Ohio." and insert--

SALEM CORPORATION, Pittsburgh, Penn.

Signed and Sealed this

*Twenty-fifth* Day of *March 1980*

[SEAL]

*Attest:*

SIDNEY A. DIAMOND

*Attesting Officer*

*Commissioner of Patents and Trademarks*